US009770077B2

(12) United States Patent
Gibbs

(10) Patent No.: US 9,770,077 B2
(45) Date of Patent: Sep. 26, 2017

(54) JEWELRY CLASP

(71) Applicant: Maria Gibbs, Valrico, FL (US)

(72) Inventor: Maria Gibbs, Valrico, FL (US)

( * ) Notice: Subject to any disclaimer, the term of this patent is extended or adjusted under 35 U.S.C. 154(b) by 0 days.

(21) Appl. No.: 14/719,835

(22) Filed: May 22, 2015

(65) Prior Publication Data

US 2016/0183644 A1 Jun. 30, 2016

Related U.S. Application Data

(60) Provisional application No. 62/098,182, filed on Dec. 30, 2014.

(51) Int. Cl.
*A44C 5/20* (2006.01)
*A44C 5/18* (2006.01)

(52) U.S. Cl.
CPC ..... *A44C 5/2047* (2013.01); *A44C 5/185* (2013.01); *Y10T 24/45534* (2015.01)

(58) Field of Classification Search
CPC ..... A44B 5/2047; Y10T 24/45534; A44C 5/2047; A44C 5/185
See application file for complete search history.

(56) References Cited

U.S. PATENT DOCUMENTS 2,513,592 A * 7/1950 Silverman ..... A44C 5/2047 24/616
4,246,680 A * 1/1981 Gray ..... A44C 5/2047 24/265 WS
4,426,854 A * 1/1984 Geldwerth ..... A44C 5/2047 228/101
4,532,682 A * 8/1985 Murao ..... A44C 5/2047 24/574.1
6,035,499 A * 3/2000 Ninomiya ..... A44C 5/2047 24/116 A

* cited by examiner

*Primary Examiner* — Abigail Troy

(57) ABSTRACT

A clasp for connecting one or more jewelry items together has a male body and a female body. The male body engages with the female body by placing an insert of the male body into an insert-receiving volume of the female body. The insert-receiving volume is defined by a shell, the shell being formed by a first surface and a second surface which are joined by a lateral surface. The insert has a planar body and a spring arm which is hingedly connected to the planar body. A lip of the shell normally prevents the insert from being moved into or out of the shell, but the free end can be pressed down by a connected tab, such that the free end does not encounter the lip. The spring arm returns to a default equilibrium position when external force is not applied via the tab.

4 Claims, 12 Drawing Sheets

JEWELRY CLASP

The current application claims a priority to the U.S. Provisional Patent application Ser. No. 62/098,182 filed on Dec. 30, 2014.

FIELD OF THE INVENTION

The present invention relates generally to an improved clasp for jewelry, more particularly to a clasp that enables a user to join the ends of one or more strands of jewelry without having to retrofit the jewelry. The present invention can be used to connect multiple strands of jewelry to form a new creative piece of jewelry.

BACKGROUND OF THE INVENTION

Jewelry, as worn by large numbers of people, is provided in a number of different styles. As jewelry is often worn as an accessory, many people have multiple pieces of jewelry that can be worn with different outfits. Sometimes, a person may choose to wear multiple jewelry pieces of the same style, e.g. rather than wearing one necklace two or more necklaces may be worn simultaneously. Other types of jewelry such as bracelets may be worn in groups in a similar manner. Doing so provides more ornamentation options, as multiple styles of necklaces or other jewelry can be worn together to effectively form a new creative jewelry arrangement. While nothing prevents multiple necklaces from being worn at the same time, it becomes more time consuming for a person to put on multiple necklaces, especially for persons who suffer from arthritis or similar ailments. Additionally, preventing said necklaces from becoming entangled with each other while being worn can be difficult, as the necklaces are not engaged with each other in any fashion.

It is therefore an object of the present invention to provide a clasp that can connect multiple jewelry items together into a new ornamental accessory. By providing two detachable bodies the present invention can connect free strands of jewelry. The two bodies each have rings that allow for interfacing with universal clasps such as lobster claws. Multiple rings allow for one or more jewelry items to be connected together via the present invention. The end result is a clasp for jewelry that minimizes tangling when wearing multiple jewelry items. The clasp is also easily operated, making a created jewelry arrangement easier to put on and take off due to the clasp acting as a single closure. Consumers are furthermore benefited with the ability to easily interchange combined jewelry items in order to keep up with evolving fashion trends.

DETAIL DESCRIPTIONS OF THE INVENTION

Figure 1:
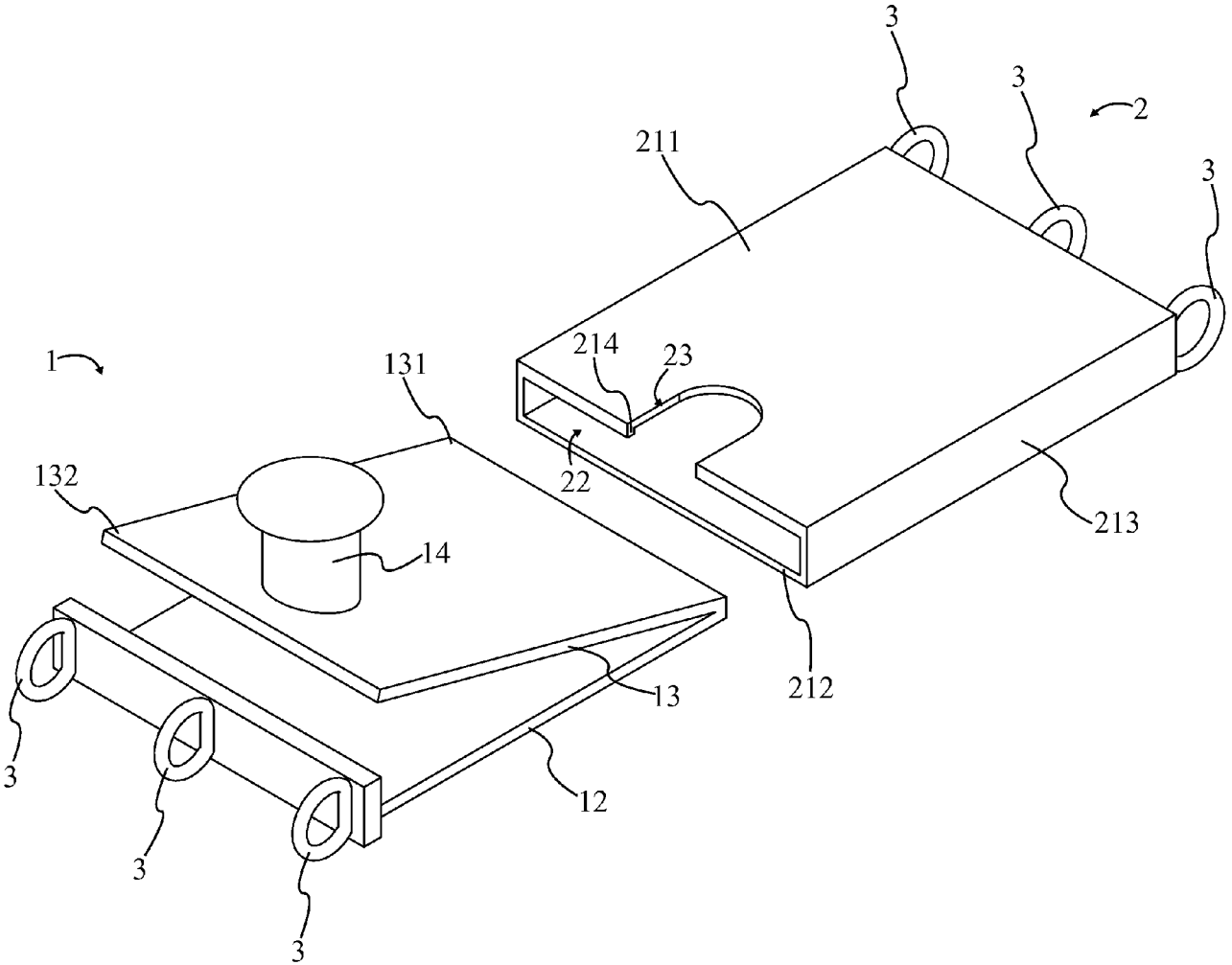
FIG. 1 is a perspective view showing a male body and a female body of the present invention in an uncoupled configuration.
Figure 2:
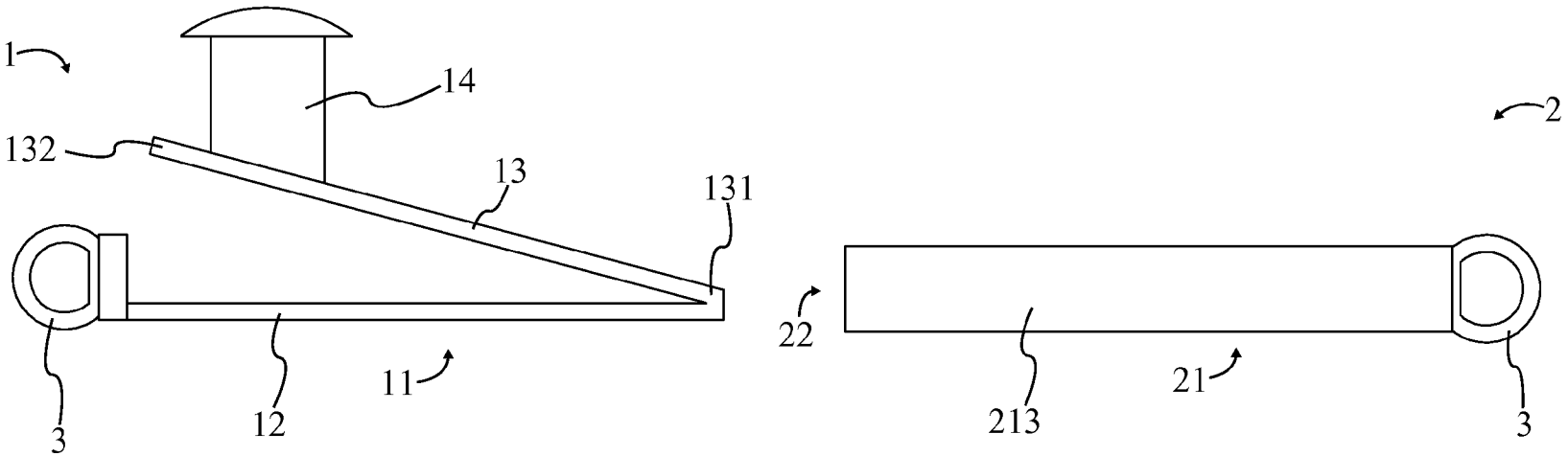
FIG. 2 is a right side elevational view showing the male body and the female body in the uncoupled configuration.
Figure 3:
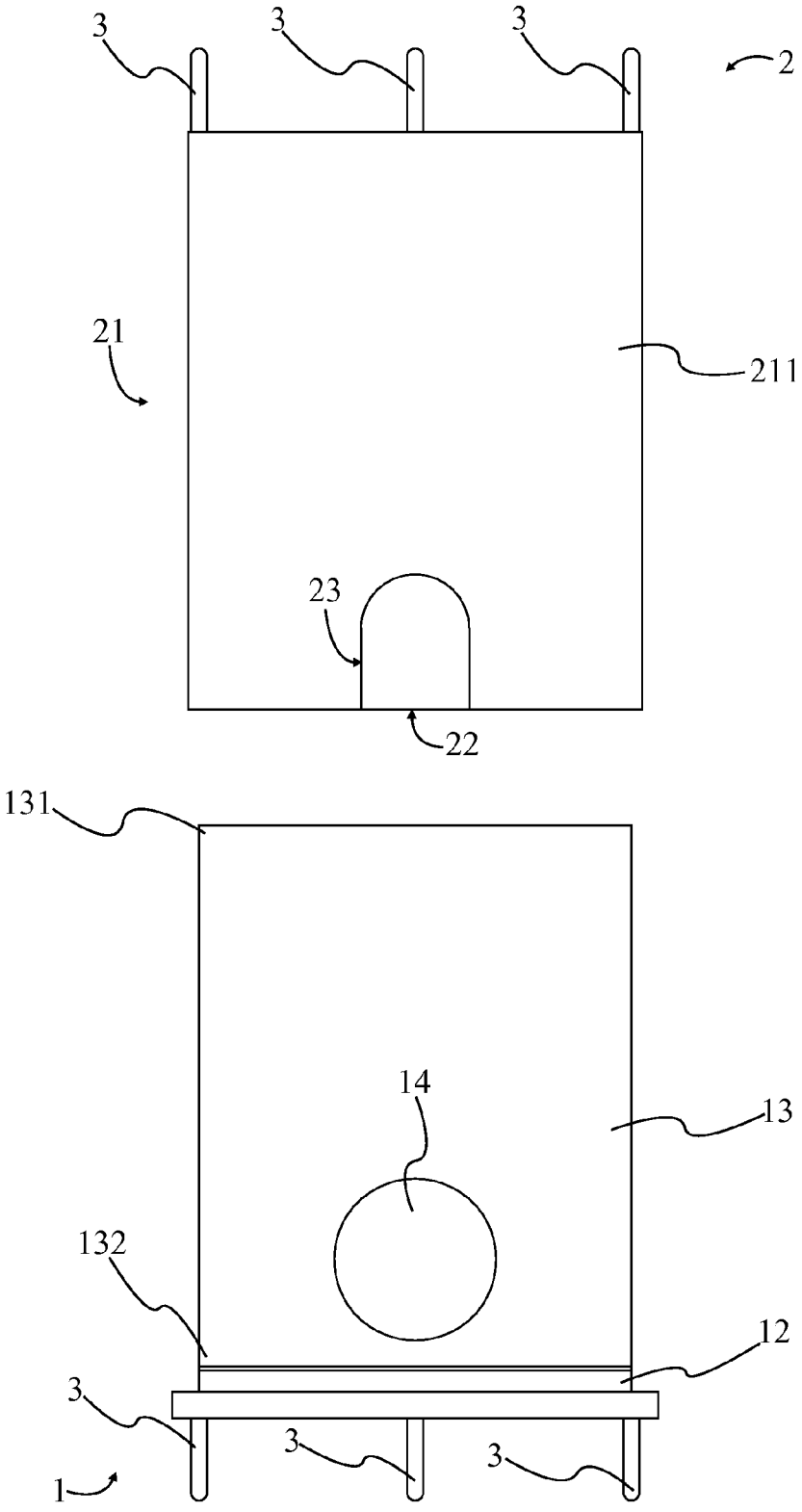
FIG. 3 is a top plan view showing the male body and the female body in the uncoupled configuration.
Figure 4:
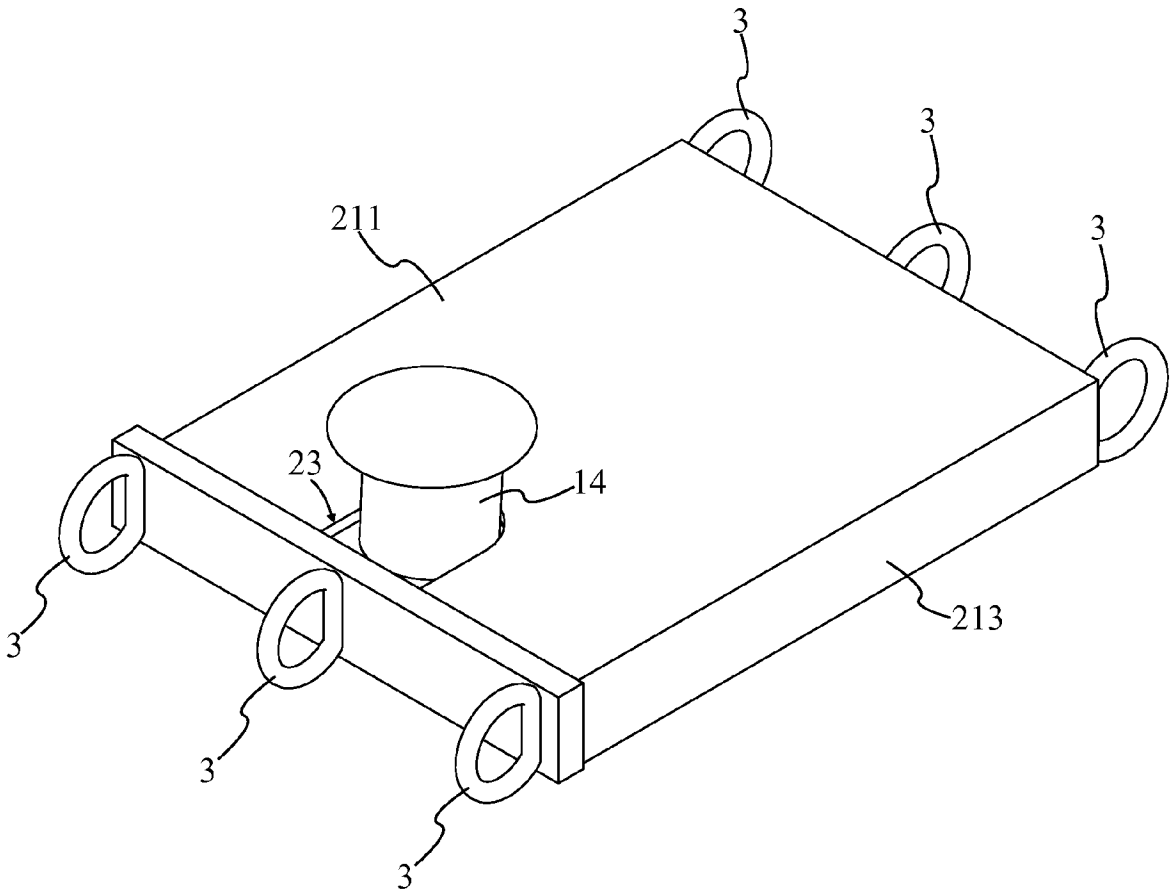
FIG. 4 is a perspective view showing the male body and the female body in a coupled configuration.
Figure 5:
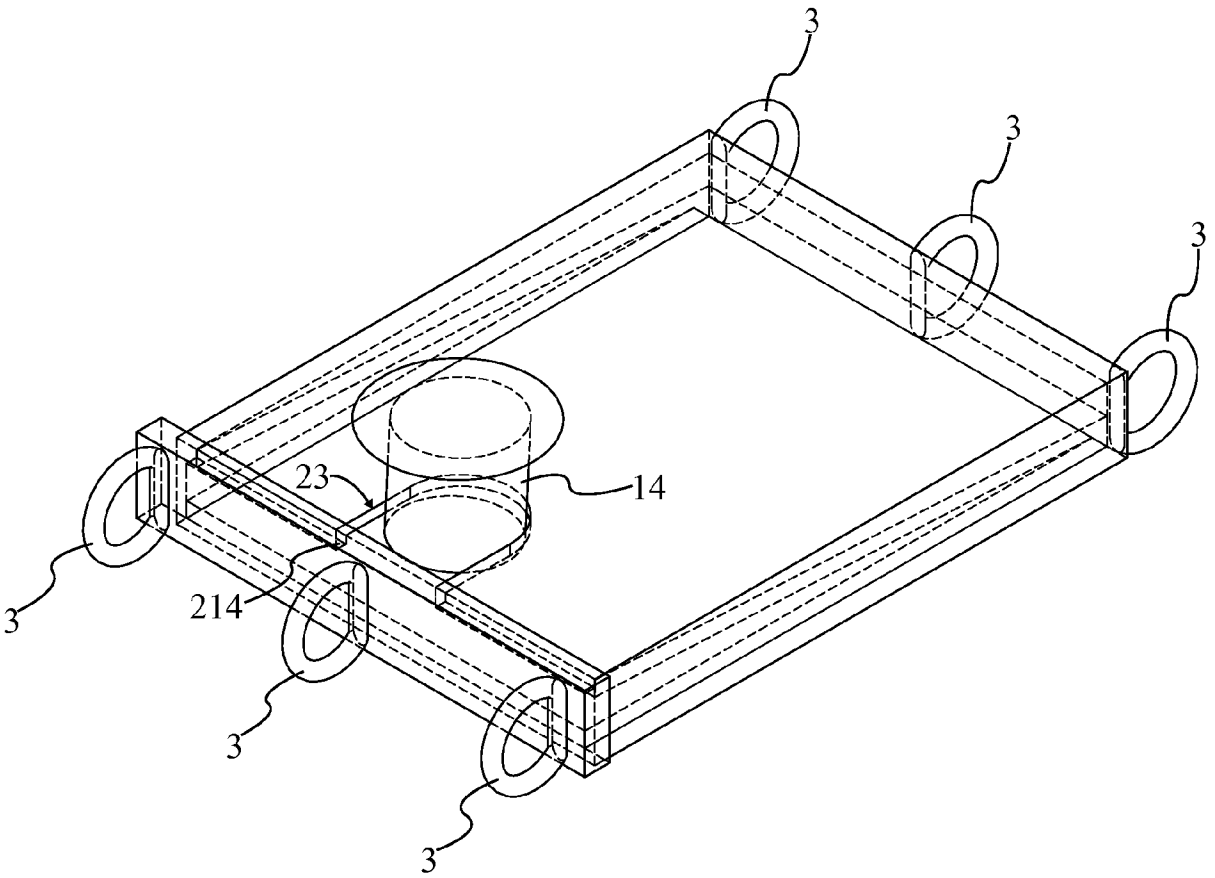
FIG. 5 is an internal perspective view showing the male body and the female body in the coupled configuration.
Figure 6:
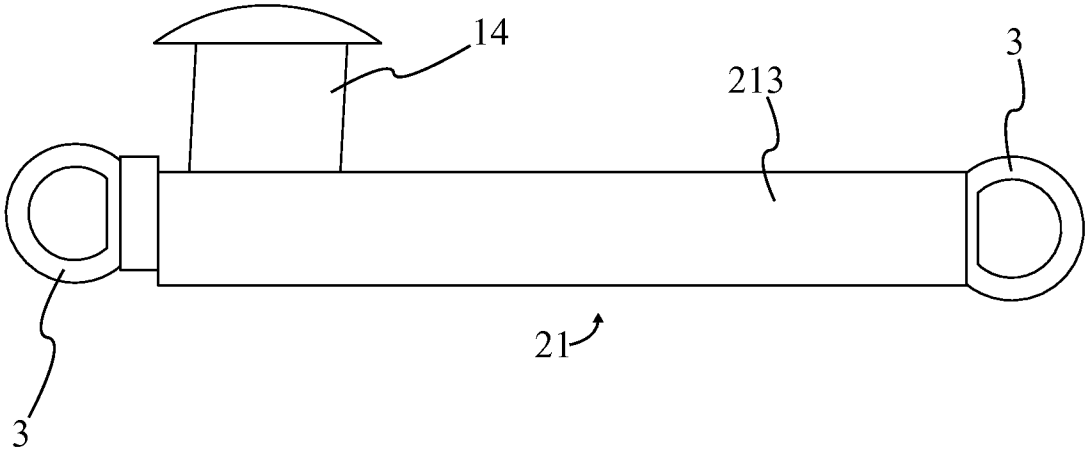
FIG. 6 is right side elevational view showing the male body and the female body in the coupled configuration.
Figure 7:
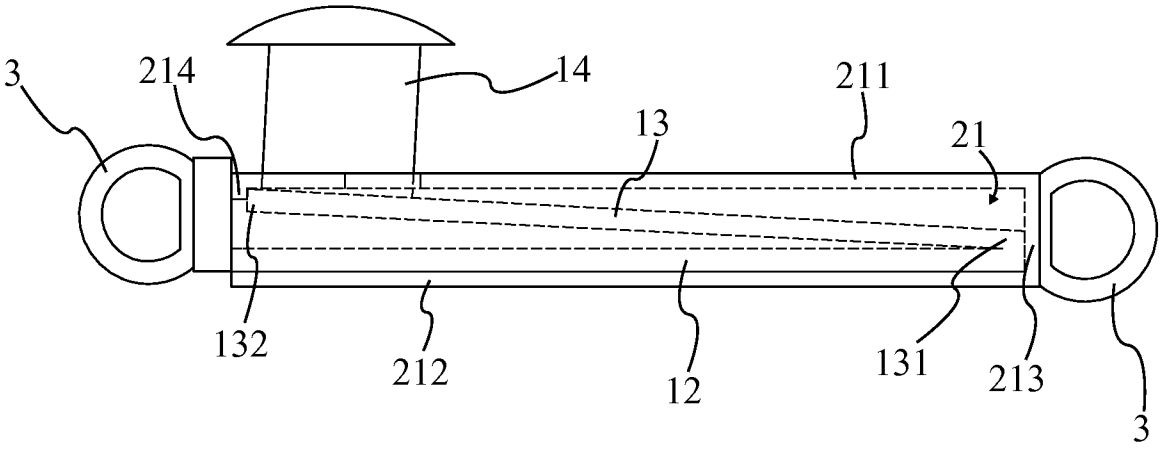
FIG. 7 is an internal right side elevational view showing the male body and the female body in the coupled configuration.
Figure 8:
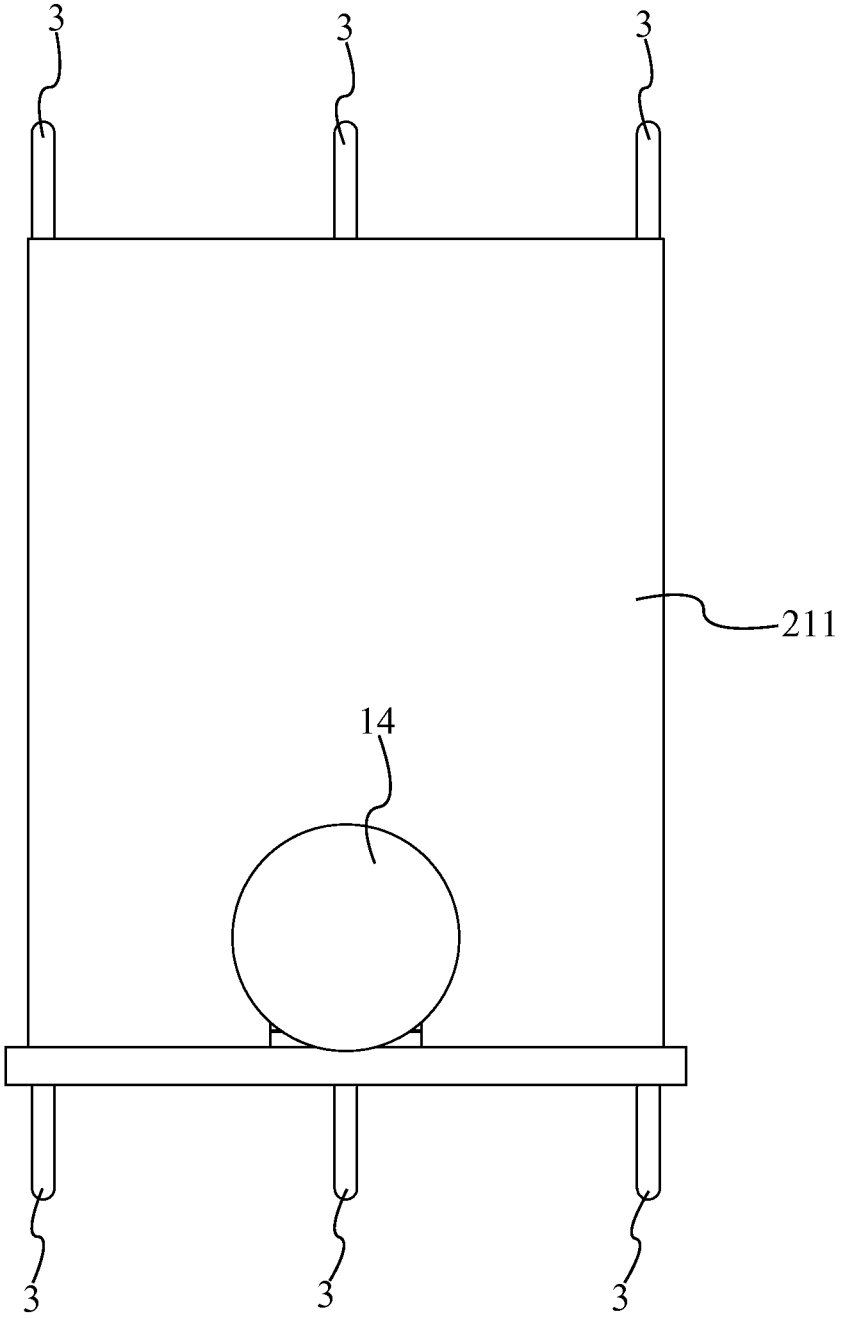
FIG. 8 is a top plan view showing the male body and the female body in the coupled configuration.

All illustrations of the drawings are for the purpose of describing selected versions of the present invention and are not intended to limit the scope of the present invention.

The present invention is a clasp that is capable of joining together loose ends of items, such as necklaces and other jewelry, through a male body 1 and a female body 2. The present invention comprises said male body 1 and female body 2, each of which comprises at least one accessory-coupling member 3. The female body 2 also comprises a shell 21 and an insert-receiving volume 22, the latter of which is positioned within the shell 21. The male body 1 and the female body 2 are coupled together, with the male body 1 being positioned into the shell 21 of the female body 2, in order to clasp together an attached item such as the aforementioned necklace. The accessory-coupling member 3 of each portion serves as an attachment point for accessory pieces like the necklace. The present invention is thus capable of being used to form creative jewelry arrangements through use of the male body 1, female body 2, and corresponding accessory-coupling members 3. The present invention is illustrated in part and as a whole via FIG. 1-FIG. 10.

The male body 1 comprises an insert 11, the insert 11 being configured to traverse into a corresponding area of the female body 2. The insert 11 itself comprises a planar body 12 and a spring arm 13, the spring arm 13 being hingedly connected to the planar body 12. The spring arm 13 is connected to an edge of the planar body 12 in order to maximize torque, especially with regards to a tab 14. The tab 14 is provided as an interfacing mechanism, allowing a person to easily press down on the spring arm 13, causing the spring arm 13 to lower and allowing the insert 11 to disengage from the female body 2. A fixed end 131 of the spring arm 13 is connected at one end of the planar body 12, effectively serving as the pivot point for the spring arm 13. A free end 132 of the spring arm 13 is positioned opposite the fixed end 131 along the spring arm 13, with the free end 132 being where the tab 14 is adjacently connected to the spring arm 13. The male body 1 is illustrated in a decoupled configuration via FIG. 1-FIG. 3, as well as shown in a coupled configuration via FIG. 4-FIG. 8.

The shell 21 of the female body 2 comprises a first surface 211, a second surface 212, a lateral surface 213, and a lip 214. The first surface 211 and second surface 212 are connected to each other by the lateral surface 213. The first surface 211, second surface 212, and lateral surface 213 define the insert-receiving volume 22, with the insert-receiving volume 22 being positioned between said first surface 211, second surface 212, and lateral surface 213. The insert-receiving volume 22 traverses into the female body 2, creating an opening in the shell 21 through which the insert-receiving volume 22 is accessible. A notch 23 is created in the first surface 211, with the tab 14 of the insert 11 traversing through the notch 23 such that it is accessible by a user, even when the insert 11 is placed within the insert-receiving volume 22. Resultantly, the insert 11 can be positioned into the insert-receiving volume 22. While other shapes, configurations, and even ornamentations for the shell 21 are possible, at the very minimum an opening is necessary to provide access into the shell 21 for the insert 11. Other components of the shell 21 may be altered depending on the particular embodiment of the present invention; however, in the preferred embodiment the first surface 211, second surface 212, lateral surface 213, and notch 23 are needed to allow the lip 214 and spring arm 13 to function properly. The female body 2 is illustrated alongside the male body 1 in FIG. 1-FIG. 3 and in a coupled configuration via FIG. 4-FIG. 8.

The lip 214 acts as a barrier to removal of the insert 11, resulting from the force generated by the spring arm 13. This relationship is subsequently elaborated upon. As the insert 11 is positioned into the insert 11-receiving cavity, the lip 214 pushes the spring arm 13 down towards the planar body 12 until the spring arm 13 completely passes the lip 214. The spring force then causes the spring arm 13 to return to an equilibrium position, with the free end 132 being pressed against the first surface 211 of the shell 21. Removal of the insert 11 is prevented by the lip 214, as the corresponding motion of the insert 11 results in the free end 132 being pressed against the lip 214.

The combination of the lip 214 and the spring arm 13 effectively acts as a latching mechanism which secures the insert 11 within the insert-receiving volume 22. By compressing and releasing the spring arm 13 of the insert 11, the male body 1 can effectively be engaged and disengaged from the female body 2.

In other embodiments, different means of securing the insert 11 within the insert-receiving volume 22 may be implemented. For example, in place of a lip 214 and a spring arm 13, a snap fit buckle could be used. In this example embodiment, the male body 1 comprises a plurality of prongs which deform under force. These prongs deform when the male body 1 is placed into the female body 2, then return to an equilibrium position once in the female body 2, with the prongs being positioned into interior recesses on either side of the shell 21. The prongs thus prevent removal of the insert 11 from the insert-receiving volume 22 unless a user intentionally applies pressure to the prongs. If pressure is applied, the prongs compress and move out of the recesses of the shell 21. Thus, the insert 11 can be removed from the insert-receiving volume 22 as desired by a user in order to detach the male body 1 from the female body 2. The aforementioned buckle is just one example of an alternative latching mechanism compared to the lip 214 and spring arm 13 of the preferred embodiment; other latching mechanisms are not precluded by the present invention. Ultimately, any latching mechanism is suitable as long as it is capable of securing the insert 11 within the insert-receiving volume 22 until a user actively disengages the coupling.

The coupled male member and female member are preferably ergonomic, with the second surface 212 being flat; this allows the shell 21 to lie flat on a user's skin, maximizing comfort. Potentially, the second surface 212 could be given a slight contour to better accommodate a person's physical features; for example, a curve could be provided to allow the present invention to better conform to wrists or necks when the present invention is being used to connect bracelets or necklaces, for example.

Figure 9:
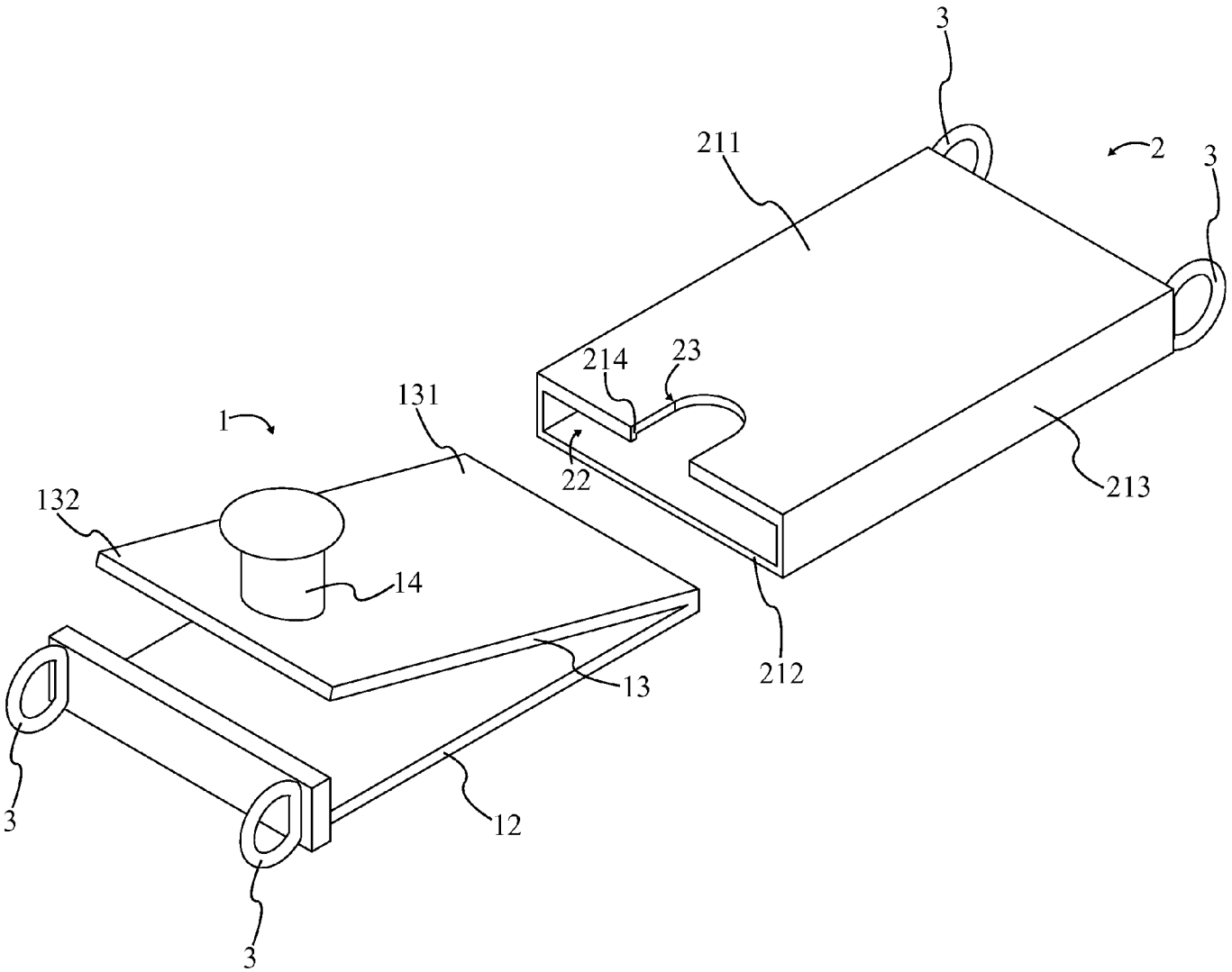
FIG. 9 is a perspective view showing an embodiment of the present invention with two rings as accessory-coupling members.
Figure 10:
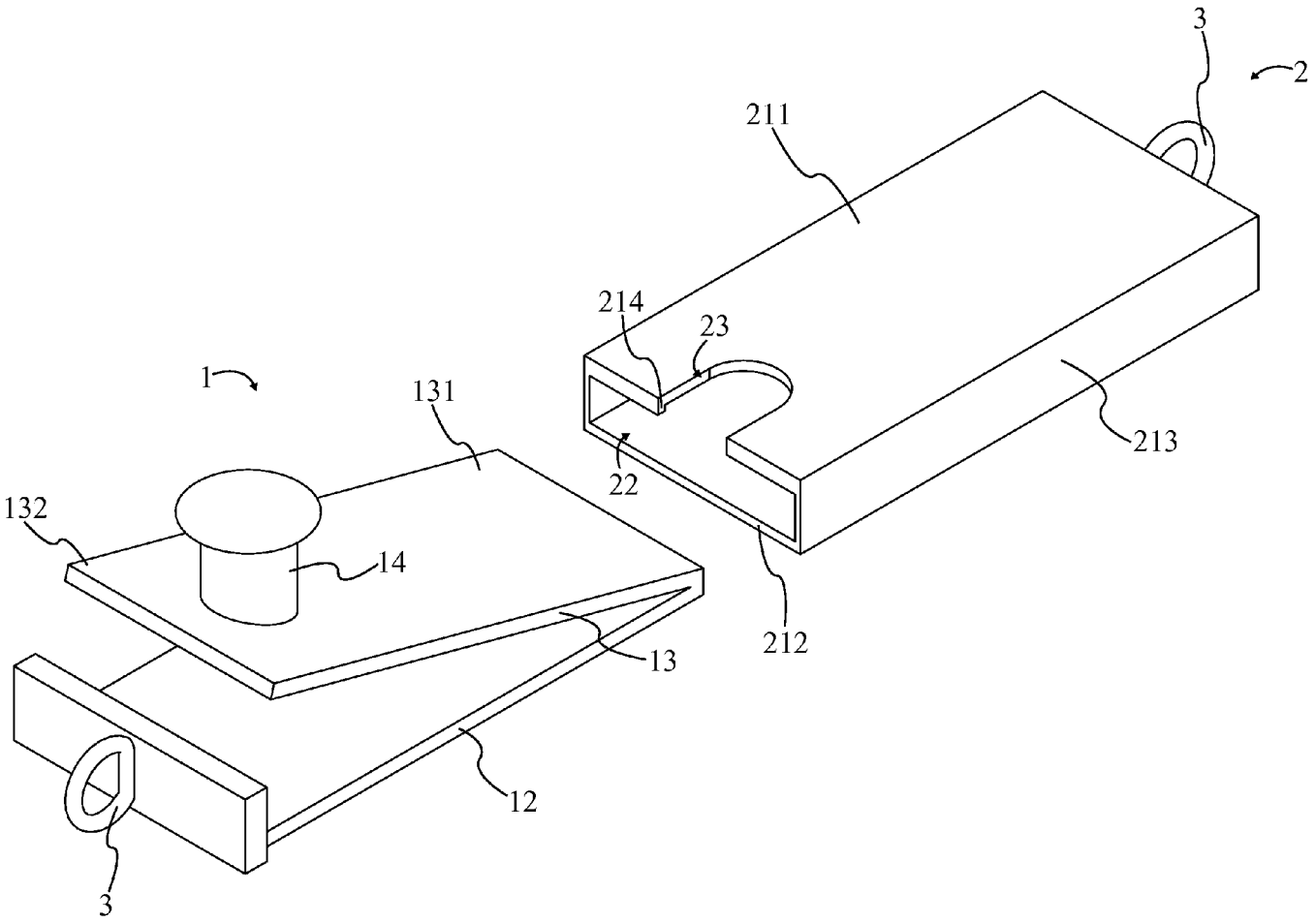
FIG. 10 is a perspective view showing an embodiment of the present invention with one ring as the accessory-coupling member.

The accessory-coupling members 3, in the preferred embodiment, are rings that allow for easy attachment of jewelry pieces (e.g. necklaces) through the use of a corresponding clasp of the jewelry. Examples of clasps commonly used for jewelry items include, but are not limited to, spring rings, lobster claws, and toggles. Further examples include latches, clips, bayonets, barrels, open boxes, s-hooks, mysteries, magnetics, pearls, and bracelet catches. By implementing the accessory-coupling members 3 as rings, the present invention is easily integrated into existing jewelry pieces. Potentially, the accessory-coupling members 3 could be implemented as different types, e.g. a magnetic connection, in order to allow the present invention to attach to different items (e.g. jewelry items which use a magnetic connection). It is noted that rings are preferable due to their compatibility with lobster claw type clasps which are commonly used in jewelry. Said compatibility allows the present invention to be used in conjunction with a majority of jewelry without requiring the jewelry (e.g. by a jeweler) to adjusted for compatibility. The present invention can utilize any number of accessory-coupling members 3; three are shown for most accompanying illustrations while FIG. 9 and FIG. 10 show different embodiments with two and one accessory-coupling members 3, respectively. The present invention can be provided with as many as ten accessory-coupling members 3, compared to the illustrated embodiments with one, two, or three accessory-coupling members 3. Conceptually, embodiments of the present invention can be provided with more than ten accessory-coupling members 3, though in practice such embodiments may prove to be bulky and unwieldy; the ideal amount of accessory-coupling members 3 ranges between one and ten.

The accessory-coupling members 3 of the female body 2 are adjacently connected to shell 21. More specifically, said accessory-coupling members 3 are adjacently connected to the lateral surface 213. In order to ensure that the accessory-coupling members 3 do not interfere with positioning of the insert 11 into the insert 11-receiving receptacle, the accessory-coupling members 3 are positioned adjacent to the lateral surface 213 opposite the insert-receiving volume 22. Thus, when the insert 11 is placed in the insert-receiving volume 22, the fixed end 131 of the spring arm 13 and the accessory-coupling members 3 are immediately adjacent to each other on either side of the lateral surface 213.

The accessory-coupling members 3 of the male body 1 are adjacently connected to the insert 11, such that said accessory-coupling members 3 remain exterior to the insert-receiving volume 22 when the insert 11 is positioned into the insert-receiving volume 22. The accessory-coupling members 3 of the male body 1 are thus positioned opposite the accessory-coupling members 3 of the female body 2 when said male body 1 and female body 2 are joined together. The present invention effectively acts as an intermediate connector for jewelry items such as necklaces.

The accessory-coupling members 3, both of the male body 1 and female body 2, allow jewelry items to be connected together by attaching the male body 1 to the female body 2. The present invention thus serves as an aesthetically pleasing intermediary connector which is used to join one or more jewelry items into a grouped accessory. Through use of the present invention, a variety of creative jewelry arrangements can be formed. For example, multiple necklaces, bracelets, anklets, and other similar chained items can be grouped together by means of the present invention and the corresponding accessory-coupling members 3. Examples of potential combinations achieved through use of the present invention are provided in FIG. 11 and FIG. 12.

The present invention itself is preferably constructed with an ornamental nature that compliments jewelry pieces. For example, while the male body 1 and female body 2 can be formed from a variety of materials, precious and aesthetically pleasing materials are preferable. Examples of said materials include, but are not limited to, silver, stainless steel, gemstones, brass, and copper. Additionally, the male body 1 and female body 2 may be decorated to enhance their ornamental appeal. The combination of the preferred material construction and additional ornamentations result in the present invention being an aesthetically pleasing connector suited for use with jewelry and other ornamental items.

In addition to allowing multiple jewelry pieces to be attached into a single accessory via the male body 1 and female body 2, the present invention allows for formed jewelry arrangements to easily be connected and disconnected. Traditionally, the clasps (e.g. lobster claws) for jewelry are small in size and require a certain dexterity to engage and disengage. The result is that utilizing traditional jewelry clasps is often difficult when a person is rushed for time or is dealing with reduced dexterity (e.g. arthritis). Because of the larger size of the male body 1 and female body 2, along with the simple to operate latching mechanism created by the tab 14 and spring arm 13, the present invention can serve as a quick-release mechanism with regards to jewelry.

Figure 11:
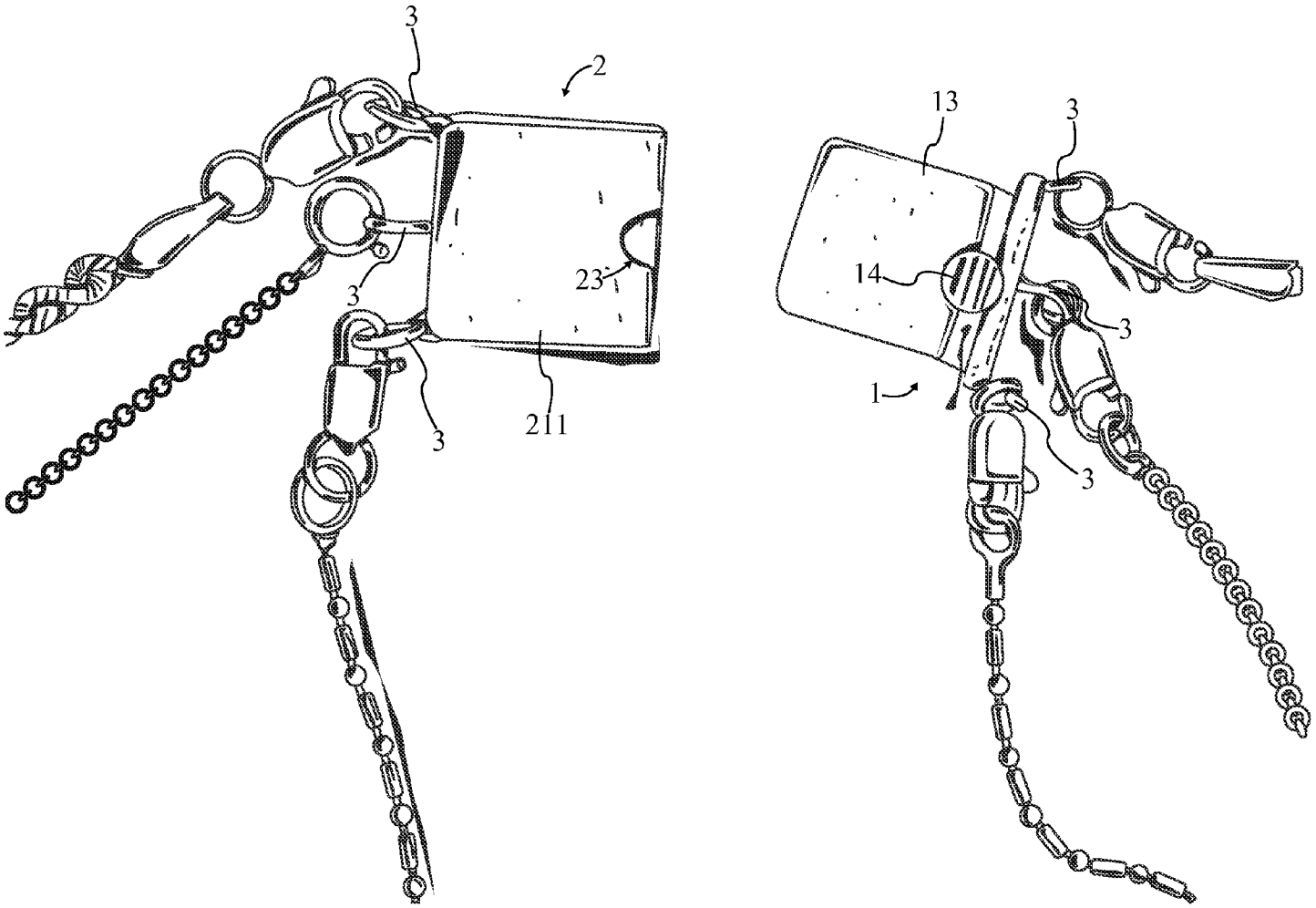
FIG. 11 is a drawing showing the male body and the female body in the uncoupled configuration, with jewelry items being connected to the male body and the female body.
Figure 12:
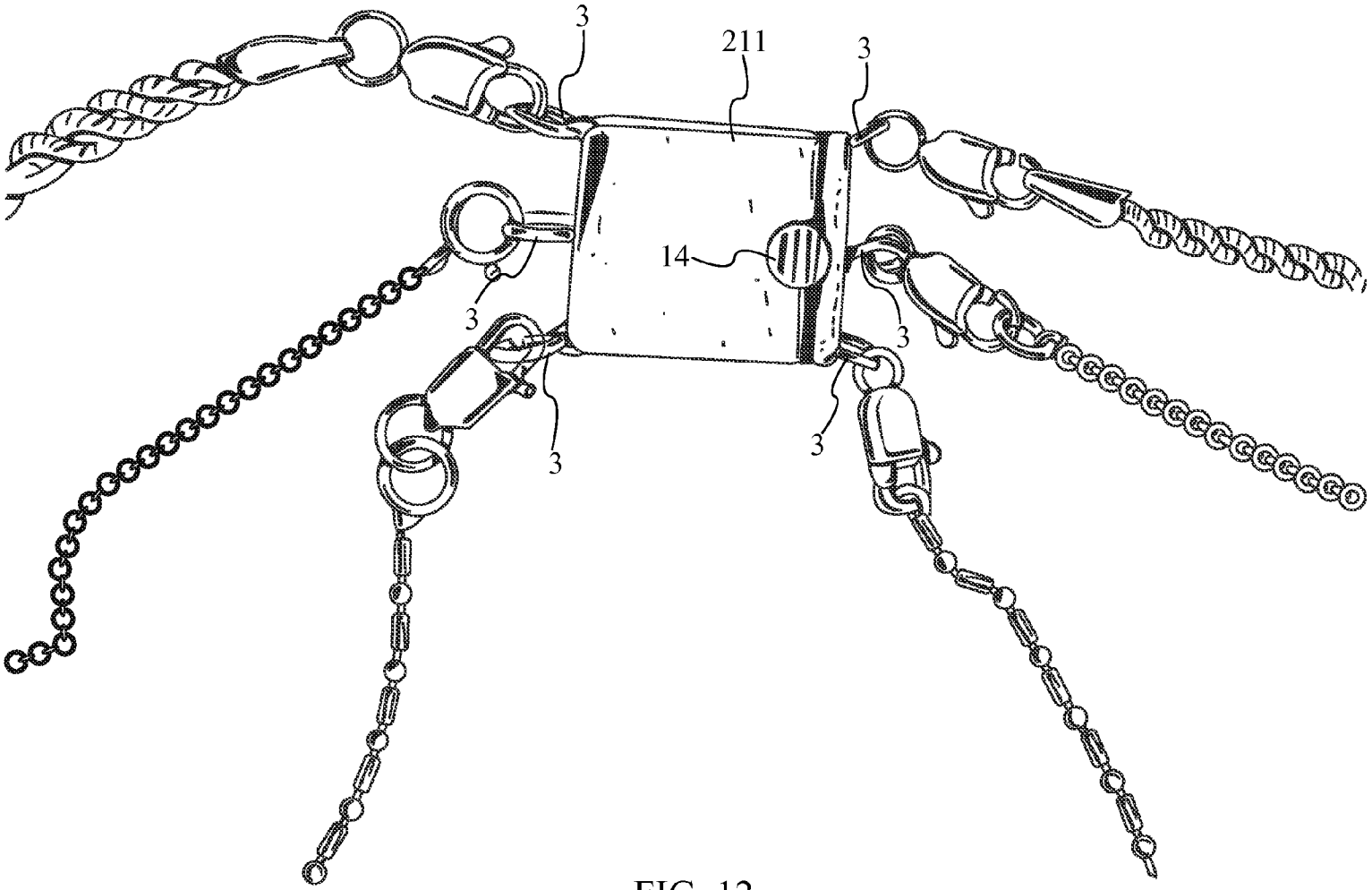
FIG. 12 is a drawing showing the male body and the female body in the coupled configuration, resulting in the formation of a creative jewelry arrangement via the connected jewelry items.

The present invention allows for connection of multiple jewelry items, the process of which is outlined below. Using necklaces as an example of a jewelry item, the male body 1 is first joined with a first end of one or more necklaces via the corresponding accessory-coupling members 3 of the male body 1. Likewise, the accessory-coupling members 3 of the female body 2 are joined with a second end of one or more necklaces. The specific number and combination of necklaces joined with the accessory-coupling members 3 is variable according to the desires of a user. Once the desired necklaces are joined with the accessory-coupling members 3, the male body 1 and the female body 2 are coupled to each other by placing the insert 11 into the insert-receiving volume 22. The male body 1 is thus secure in the female body 2 until a user desires to disengage the male body 1 from the female body 2, which is accomplished by pressing down on the tab 14 in order to lower the spring arm 13, thus allowing the insert 11 be pulled out of the insert-receiving volume 22 without being stopped by the lip 214. FIG. 11 and FIG. 12 illustrate the present invention prior to connecting multiple jewelry items and after connecting multiple jewelry items, respectively.

Though the present invention has primarily been described as being used in conjunction with jewelry, it is not limited to such. As a clasp, the present invention can ultimately be used to secure any appropriately equipped object (i.e. any objects that are capable of attaching to the accessory-coupling members 3).

Although the invention has been explained in relation to its preferred embodiment, it is to be understood that many other possible modifications and variations can be made without departing from the spirit and scope of the invention as hereinafter claimed.

What is claimed is:

1. A jewelry clasp comprising:

a male body;

a female body;

the male body being coupled to the female body;

the male body comprising an insert;

the insert comprising a planar body, a spring arm and a tab;

the tab being configured to be directly pressed down to disengage the male body from the female body;

the female body comprising a shell and an insert-receiving volume;

the male body and the female body each comprising at least one accessory-coupling member;

the insert-receiving volume traversing into the shell;

the insert being configured to be accommodated within the insert-receiving volume;

the at least one accessory-coupling member of the male body being adjacently connected to the insert;

the at least one accessory-coupling member of the female body being adjacently connected to the shell;

the spring arm being adjacently connected to the planar body;

the tab being adjacently connected to the spring arm;

the spring arm comprising a fixed end and a free end;

the fixed end being hingedly connected to the planar body;

the tab being positioned adjacent to the free end;

the shell comprising a first surface, a second surface, a lateral surface, a notch and a lip;

the first surface being connected to the second surface by the lateral surface;

the insert-receiving volume being positioned between the first surface, the second surface and the lateral surface;

the lip being adjacently connected to the first surface;

the lip being positioned adjacent to the insert-receiving volume;

the lip being configured to prevent removal of the insert from the insert-receiving volume in response to the insert being accommodated within the insert-receiving volume;

the notch being formed on the first surface;

the notch penetrating through the first surface;

the notch being communicated with the insert-receiving volume;

the notch being positioned adjacent to the lip;

the tab comprising a neck portion and a head portion;

the neck portion and the head portion being connected to each other;

the notch comprising a notch periphery;

the neck portion comprising a neck periphery;

the head portion comprising a head periphery; and the notch periphery being larger than the neck periphery and smaller than the head periphery, such that the head portion is prevented from being pressed into and hidden within the notch and the insert-receiving volume when the neck portion penetrates through the notch and the insert is accommodated within the insert-receiving volume.

2. The jewelry clasp as claimed in claim 1, wherein:

the at least one accessory-coupling member of the male body is adjacently connected to the planar body of the insert; and the at least one accessory-coupling member of the male body is positioned opposite the fixed end across the planar body.

3. The jewelry clasp as claimed in claim 1, wherein:

the at least one accessory-coupling member of the female body is adjacently connected to the lateral surface; and the at least one accessory-coupling member of the female body is positioned opposite the insert-receiving volume through the lateral surface.

4. The jewelry clasp as claimed in claim 1, wherein:

at least one of the at least one accessory-coupling member of the male body and the at least one accessory-coupling member of the female body is a ring.

* * * * *